US008059140B2

(12) United States Patent
Kwon et al.

(10) Patent No.: US 8,059,140 B2
(45) **Date of Patent: *Nov. 15, 2011**

(54) DATA DRIVER AND FLAT PANEL DISPLAY DEVICE USING THE SAME

(75) Inventors: Oh Kyong Kwon, Seoul (KR); Byong Deok Choi, Seoul (KR)

(73) Assignee: Samsung Mobile DIsplay Co., Inc., Yongin (KR)

( * ) Notice: Subject to any disclaimer, the term of this patent is extended or adjusted under 35 U.S.C. 154(b) by 1325 days.

This patent is subject to a terminal disclaimer.

(21) Appl. No.: 11/700,746

(22) Filed: Jan. 30, 2007

(65) Prior Publication Data

US 2007/0234152 A1 Oct. 4, 2007

(30) Foreign Application Priority Data

Feb. 9, 2006 (KR) ..... 10-2006-0012559

(51) Int. Cl.
*G09G 5/10* (2006.01)

(52) U.S. Cl. ..... 345/690; 345/691; 345/692

(58) Field of Classification Search ..... 345/87–104, 345/76–83, 690–692
See application file for complete search history.

(56) References Cited

U.S. PATENT DOCUMENTS

| | | | |
|---|---|---|---|
| 4,394,662 | A | 7/1983 | Yoshida et al. |
| 5,170,158 | A | 12/1992 | Shinya |
| 5,299,165 | A | 3/1994 | Kimura et al. |
| 5,381,798 | A | 1/1995 | Burrows |
| 6,271,784 | B1 | 8/2001 | Lynn et al. |
| 6,310,593 | B1 | 10/2001 | Nakao |
| 6,380,917 | B2 | 4/2002 | Matsueda et al. |
| 6,424,331 | B1 | 7/2002 | Ozawa |
| 6,897,846 | B2 | 5/2005 | Youn |
| 6,980,189 | B2 | 12/2005 | Maruoka et al. |

(Continued)

FOREIGN PATENT DOCUMENTS

CN 1287653 A 3/2001

(Continued)

OTHER PUBLICATIONS

Patent abstract of Japan for publication No. 2003-162265 dated Jun. 6, 2003 in the name of Akihisa Iwamoto et al.

(Continued)

*Primary Examiner* — Richard Hjerpe
*Assistant Examiner* — Dorothy Harris
(74) *Attorney, Agent, or Firm* — Christie, Parker & Hale, LLP

(57) ABSTRACT

A flat panel display device including: a display region including pixels connected to scan lines and data lines; a dummy display region including dummy pixels connected to at least two dummy scan lines and the data lines; a scan driver for providing scan signals and dummy scan signals to the scan lines and the dummy scan lines; a data driver for generating gray scale voltages corresponding to input digital data and providing them to corresponding pixels through the data lines; and a timing controller for controlling the scan driver and the data driver, wherein the data driver uses parasitic capacitance components existing in at least two data lines and capacitance components in the pixels and the dummy pixels connected to the at least two data lines, as a sampling capacitor and a holding capacitor to generate the gray scale voltages through charge sharing between the at least two data lines.

20 Claims, 9 Drawing Sheets

U.S. PATENT DOCUMENTS

| | | | | |
|---|---|---|---|---|
| 7,221,349 | B2 | 5/2007 | Hashido et al. | |
| 7,239,297 | B2 | 7/2007 | Tajima et al. | |
| 7,542,031 | B2 | 6/2009 | Jo et al. | |
| 7,605,790 | B2 | 10/2009 | Hsu | |
| 7,629,952 | B2 | 12/2009 | Burr et al. | |
| 2002/0027799 | A1 | 3/2002 | Sakata et al. | |
| 2002/0060657 | A1 | 5/2002 | Matsueda et al. | |
| 2002/0154253 | A1 | 10/2002 | Cairns et al. | |
| 2002/0158828 | A1 | 10/2002 | Isami et al. | |
| 2003/0030614 | A1 | 2/2003 | Tajima et al. | |
| 2003/0146896 | A1 | 8/2003 | Sekine | |
| 2004/0125422 | A1 | 7/2004 | Wang et al. | |
| 2004/0174448 | A1 | 9/2004 | Azami | |
| 2004/0207779 | A1 | 10/2004 | Herrmann | |
| 2005/0001799 | A1 | 1/2005 | Kim | |
| 2005/0259064 | A1 | 11/2005 | Sugino et al. | |
| 2006/0092121 | A1 | 5/2006 | Watanabe et al. | |
| 2006/0192740 | A1 | 8/2006 | Lim | |
| 2006/0202928 | A1* | 9/2006 | Edwards | 345/88 |
| 2007/0182692 | A1* | 8/2007 | Kwon et al. | 345/100 |
| 2007/0242535 | A1 | 10/2007 | Kajigaya et al. | |
| 2007/0290969 | A1 | 12/2007 | Hsu | |

FOREIGN PATENT DOCUMENTS

| | | | |
|---|---|---|---|
| CN | 1398391 | A | 2/2003 |
| JP | 05-204339 | | 8/1993 |
| JP | 06-224768 | | 8/1994 |
| JP | 07-199866 | | 8/1995 |
| JP | 10-326089 | | 12/1998 |
| JP | 2001-134249 | | 5/2001 |
| JP | 2001-215472 | | 8/2001 |
| JP | 2002-505828 | | 2/2002 |
| JP | 2002-108296 | | 4/2002 |
| JP | 2002-202762 | | 7/2002 |
| JP | 2003-114415 | | 4/2003 |
| JP | 2003 162265 | | 6/2003 |
| JP | 2003-228339 | | 8/2003 |
| JP | 2003-344824 | | 12/2003 |
| JP | 2004-295103 | | 10/2004 |
| JP | 2004-356875 | | 12/2004 |
| JP | 2004-361841 | | 12/2004 |
| JP | 2005-24821 | | 1/2005 |
| JP | 2005-070627 | | 3/2005 |
| JP | 2005-134435 | | 5/2005 |
| JP | 2005-242294 | | 9/2005 |
| JP | 2005-346077 | | 12/2005 |
| JP | 2006-030921 | | 2/2006 |
| JP | 2007-212993 | | 8/2007 |
| KR | 2002-0004281 | | 1/2002 |
| KR | 10-0375203 | | 7/2002 |
| KR | 10-2003-0057771 | | 7/2003 |
| KR | 2003-0061553 | | 7/2003 |
| KR | 10-2004-0041810 | | 5/2004 |
| KR | 10-2004-0060708 | | 7/2004 |
| KR | 10-2005-0000161 | | 1/2005 |
| KR | 10-2005-0116098 | | 12/2005 |
| KR | 10-2006-0011509 | | 2/2006 |
| KR | 10-2006-0037861 | | 5/2006 |
| WO | WO 98/48317 | | 10/1998 |
| WO | WO 00/23977 | | 4/2000 |
| WO | WO 02/21496 | A2 | 3/2002 |
| WO | WO 2005/017867 | A1 | 2/2005 |
| WO | WO 2005/078696 | A1 | 8/2005 |

OTHER PUBLICATIONS

Patent abstract of Japan for publication No. 2005-024821 dated Jan. 27, 2005 in the name of Kensuke Maezono.

Korean patent abstract for publication No. 1020030061553 A dated Jul. 22, 2003 in the name of Seok U. Lee, et al.

Korean patent abstract for publication No. 1020040041810 A dated May 20, 2004 in the name of Jae U. Lee, et al.

Korean Patent Abstracts, Publication No. 1020020004281 A; Publication Date: Jan. 16, 2002; in the name of Lee et al.

Korean Patent Abstracts for Registered Korean Patent 10-0375203, Publication No. 1020020056354 A; Publication Date: Jul. 10, 2002; in the name of Kwon.

Korean Patent Abstracts, Publication No. 1020060037861 A; Publication Date: May 3, 2006; in the name of Lee.

European Search Report dated Jul. 3, 2007, for European Patent application 07250231.3.

SIPO Office action dated Mar. 28, 2008, for Chinese Patent application 200610168767.0, with English translation.

European Search Report dated Aug. 25, 2008, for European Patent application 07250231.3.

Japanese Office action dated Dec. 16, 2008 for corresponding Japanese Patent application 2006-252661.

European Search Report dated May 15, 2007, for European Patent application 07250524.1.

SIPO Office action dated Jun. 6, 2008, for Chinese Patent application 200710001990.0, with English translation.

European Search Report dated Jun. 27, 2007, for European Patent application 07250525.8.

SIPO Office action dated Aug. 8, 2008, for Chinese Patent application 200710004221.6, with English translation.

European Search Report dated Aug. 25, 2008, for European Patent application 07250525.8.

Japanese Office action dated Mar. 30, 2010 for Japanese Patent application 2006-199463.

Japanese Office action dated Mar. 23, 2010 for Japanese Patent application 2006-221887.

Japanese Office action dated Sep. 7, 2010 for Japanese Patent application 2006-199463.

U.S. Office action dated Oct. 18, 2010, for cross-reference U.S. Patent application.

U.S. Office action dated Oct. 7, 2010, for cross-reference U.S. Patent application.

U.S. Notice of Allowance dated Feb. 22, 2011, for cross reference U.S. Appl. No. 11/656,805, noting listed references in this IDS.

Japanese Office action dated Mar. 23, 2010, for corresponding Japanese Patent application 2006-217194, noting listed references in this IDS.

European Search Report, dated Jul. 7, 2007, for European Application No. EP 07250542.3, in the name of Samsung SDI Co., Ltd.

Japanese Office action dated Sep. 14, 2010 issued by the Japanese Patent Office for Japanese Application No. 2006-21794, listing the cited references in the IDS.

* cited by examiner

DATA DRIVER AND FLAT PANEL DISPLAY DEVICE USING THE SAME

CROSS-REFERENCE TO RELATED APPLICATION

This application claims priority to and the benefit of Korean Patent Application No. 10-2006-0012559, filed on Feb. 09, 2006, in the Korean Intellectual Property Office, the entire content of which is incorporated herein by reference.

BACKGROUND

1. Field of the Invention

The present invention relates to a flat panel display device, and more particularly, to a data driver and a flat panel display device using the same, which can generate gray scale voltages through charge sharing between at least two data lines provided on a panel of the display device and then provide the gray scale voltages to corresponding pixels.

2. Discussion of Related Art

A flat panel display device includes a display panel, a scan driver, and a data driver. The scan driver sequentially outputs scan driving signals to a plurality of scan lines formed on the display panel, and the data driver outputs R, G, B image signals to data lines on the display panel. Non-limiting examples of a flat panel display device include a liquid crystal display device, a field emission display device, a plasma display panel, a light emitting display device, etc.

FIG. 1 is a block diagram showing a conventional data driver.

Here, the data driver will be described on the assumption that it has n channels.

Referring to FIG. 1, the data driver includes: a shift register unit 110, a sampling latch unit 120, a holding latch unit 130, a digital-analog converter (DAC) 140, and an amplifier 150.

The shift register unit 110 receives a source shift clock (SSC) and a source start pulse (SSP) from a timing controller (not shown), and generates n sampling signals in sequence, while allowing the source start pulse (SSP) to be shifted for every one period of the source shift clock (SSC). To generate the n sampling signals, the shift register unit 110 includes n shift registers.

The sampling latch unit 120 sequentially stores data in response to the sampling signals supplied from the shift register 110 in sequence. Here, the sampling latch unit 120 is provided with n sampling latches for storing n digital data. Also, the respective sampling latches have sizes corresponding to the number of bits of the data. For example, when the data is configured to have k bits, the respective sampling latches are set to have a size of k bits.

The holding latch unit 130 receives and stores the data from the sampling latch unit 120 when a source output enable (SOE) signal is input. Also, the holding latch unit 130 supplies the data stored therein to a DAC 250, when the source output enable (SOE) signal is input. Here, the holding latch unit 130 is provided with n holding latches for storing n data. Also, the respective holding latches have sizes corresponding to the number of bits of the data. For example, the respective holding latches are set to have a size of k bits for storing the data having k bits.

The DAC 140 generates an analog signal corresponding to the bit value of the input digital data, and the DAC 140 selects any one of a plurality of gray scale voltages (or gray levels) corresponding to the bit values of the data supplied from the holding latch unit 130, thereby generating an analog data signal.

The amplifier 150 amplifies the digital data converted into the analog signal to a certain or predetermined level and thus outputs it through data lines on a panel.

As such, the data driver of FIG. 1 outputs one data per one horizontal period. That is, after the data driver samples and holds one digital R, G, B data (or one set of R, G, B data) during one horizontal period, it converts them into analog R, G, B data and amplifies and outputs them at a certain or predetermined width. In addition, when the holding latch unit 130 holds the R, G, B data corresponding to $n^{th}$ column line, the sampling latch unit 120 samples the R, G, B data corresponding to $n+1^{th}$ column line.

FIG. 2 is a block diagram showing the DAC shown in FIG. 1.

Referring to FIG. 2, a conventional DAC 140 includes: a reference voltage generator 142, a level shifter 144, and a switch array 146.

As shown in FIG. 2, the DAC 140 uses a reference voltage generator 142 having R-strings R1, R2, . . . Rn for generating correct gray scale voltages and/or gamma-corrections and includes a ROM type of a switch array 146 for selecting the voltages generated through the reference voltage generator 142.

The DAC 140 includes a level shifter for converting and providing a voltage level for digital data input through the sampling latch unit (120 in FIG. 1) to the switch array 146.

The DAC 140 has a disadvantage because power consumption is increased due to a static current of the R-strings. In order to overcome this disadvantage, an approach has been developed in which the R-strings are designed with large resistance values for reducing the static current flowing into the R-strings, and in which the desired gray scale voltages are applied to the respective data lines by using an analog buffer in the respective channels as the amplifier 150. However, this approach has a disadvantage because image quality is deteriorated due to the output voltage difference between channels, when threshold voltages and mobility of certain transistors constituting portions of the analog buffer are not uniform.

Also, in implementing a gray scale of 6 bits, 6-64 switches for selecting one of 64 gray scale voltages (or gray levels) should be built in the respective channels, causing a disadvantage in that circuit area is greatly increased. In an embodiment of the prior art, the area of a DAC implementing the gray scale of 6 bits occupies more than half of the area of a data driver.

As the bits of a gray scale (or the number of gray levels) are increased, even more circuit area may be needed. For example, in implementing a gray scale of 8 bits, the circuit area of a data driver can be increased to more than four times the circuit area of the DAC implementing the gray scale of 6 bits.

Also, recently, a flat panel display device using a system on panel (SOP) process that uses polycrystalline silicon TFTs to integrate driver(s), etc., along with a display region on a substrate has been developed. The above described disadvantages of the conventional DAC, i.e., the problems of power consumption and/or area usage, and the problem of implementing the analog buffer as the amplifier, become even more pronounced, when the flat panel display device is implemented using the SOP process.

SUMMARY OF THE INVENTION

It is an aspect of the present invention to provide a data driver and a flat panel display device using the same, wherein the data driver uses parasitic capacitance components existing in at least two data lines of a plurality of data lines on a panel of the display device and capacitance components in pixels and dummy pixels connected to the respective data lines as a sampling capacitor and a holding capacitor to generate desired gray scale voltages through charge sharing between the data lines, thereby minimizing the circuit area and power consumption of a DAC.

According to a first embodiment of the present invention, there is provided a flat panel display device including: a display region including a plurality of pixels connected to a plurality of scan lines and a plurality of data lines; a dummy display region including a plurality of dummy pixels connected to at least two dummy scan lines and the data lines; a scan driver for providing scan signals and dummy scan signals to the scan lines and the dummy scan lines; a data driver for generating gray scale voltages corresponding to input digital data and for providing the gray scale voltages to corresponding ones of the pixels through the data lines; and a timing controller for controlling the scan driver and the data driver, wherein the data driver uses parasitic capacitance components existing in at least two of the data lines and capacitance components in the pixels and the dummy pixels connected to the at least two of the data lines, as a sampling capacitor and a holding capacitor to generate the gray scale voltages through charge sharing between the at least two of the data lines.

According to a second embodiment of the present invention, there is provided a data driver including: a shift register unit for providing sampling signals by generating at least one shift register clock; a sampling latch unit for sampling and latching digital data having a plurality of bits by receiving the sampling signals for every column line; a holding latch unit for simultaneously receiving and latching digital data latched in the sampling latch unit, and for converting and outputting the digital data in a serial state for each of the bits; and a digital-analog converter for generating gray scale voltages to correspond to bit values of the digital data supplied from the holding latch unit in a serial state and for providing the gray scale voltages to respective data lines, wherein the digital-analog converter uses parasitic capacitance components existing in at least two of the data lines provided on a panel of a display device including the data driver and capacitance components in pixels and dummy pixels connected to the at least two of the data lines, as a sampling capacitor and a holding capacitor to generate the gray scale voltages through charge sharing between the at least two of the data lines.

According to a third embodiment of the present invention, there is provided a data driving method of a flat panel display device including: serially inputting respective bits of digital data; executing charge sharing between data lines by using parasitic capacitance components existing in at least two data lines provided on a panel of the display device and capacitance components in pixels and dummy pixels connected to the at least two data lines, as a sampling capacitor and a holding capacitor for a plurality of periods during which the respective bits of the digital data are input; and applying a result of the charge sharing executed at a last one of the plurality of periods to corresponding ones of the pixels through the at least two data lines as final gray scale voltages.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 3:
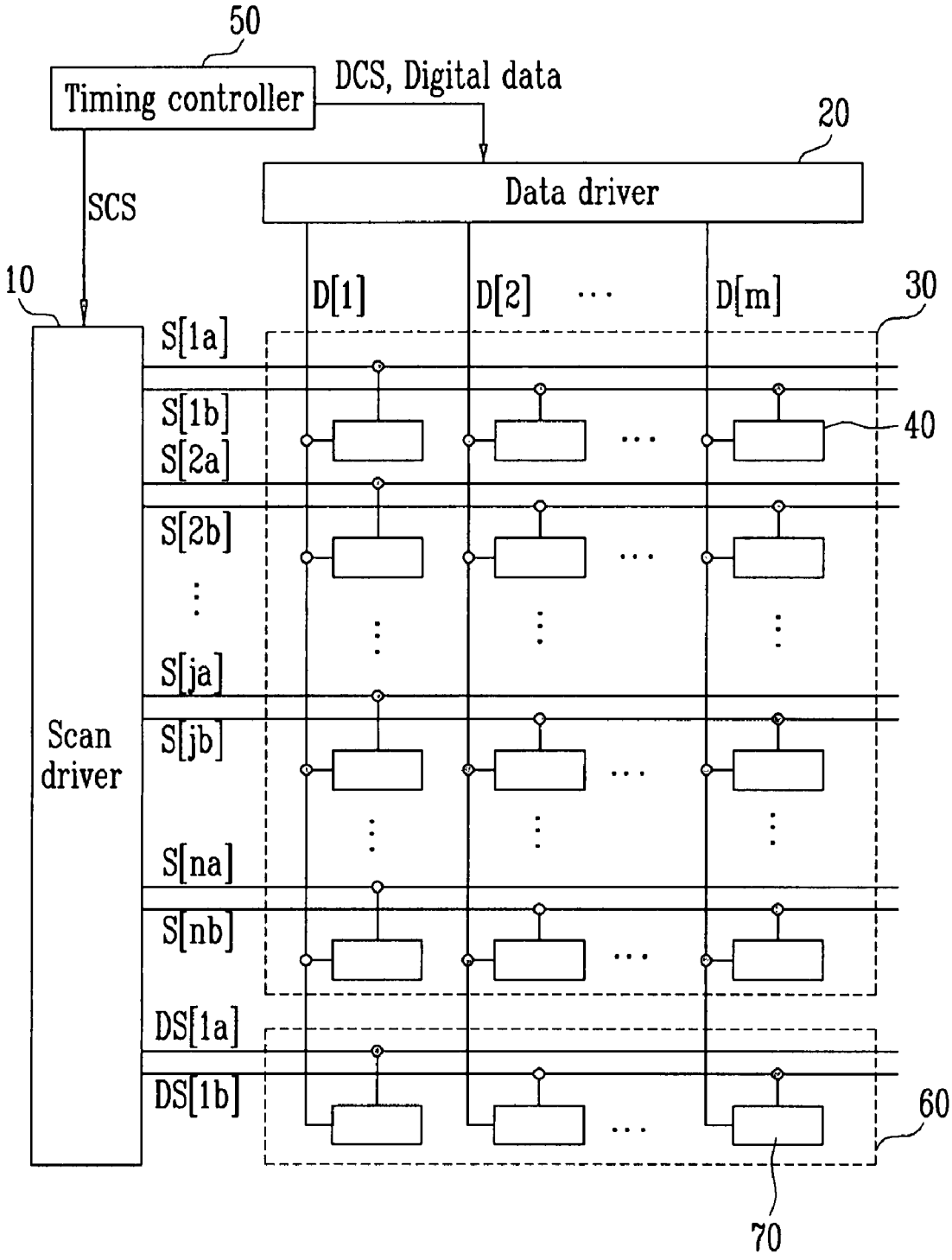
FIG. 3 is a block diagram showing a flat panel display device according to an embodiment of the present invention.

FIG. 3 is a block diagram showing a flat panel display device according to an embodiment of the present invention.

Referring to FIG. 3, the flat panel display device according to the embodiment of the present invention includes: a display region 30 including a plurality of pixels 40 connected to scan lines S[1a], S[1b] to S[na], S[nb] and data lines D[1] to D[m]; a dummy display region 60 including a plurality of dummy pixels 70 connected to at least two dummy scan data lines DS[1a], DS[1b] and the data lines D[1] to D[m]; a scan driver 10 for driving the scan lines S[1a], S[1b] to S[na], S[nb] and the dummy scan lines DS[1a], DS[1b]; a data driver 20 for driving the data lines D[1] to D[m]; and a timing controller 50 for controlling the scan driver 10 and the data driver 20.

Here, the timing controller 50 generates a data driving control signal (DCS) and a scan driving control signal (SCS) in response to synchronizing signals supplied from one or more external sources. The data driving control signal (DCS) generated from the timing controller 50 is supplied to the data driver 20, and the scan driving control signal (SCS) is supplied to the scan driver 10. Also, the timing controller 50 supplies digital data supplied from an external source to the data driver 20.

In addition, the scan driver 10 generates scan signals by receiving the scan driving control signal (SCS) from the timing controller 50, and sequentially supplies the generated scan signals to the scan lines S[1a], S[1b] to S[na], S[nb].

However, in a case of the present invention, the scan signals are sequentially supplied to the scan lines S[1a], S[1b] to S[na], S[nb] and are also alternately supplied to at least two of the dummy scan lines DS[1a], DS[1b].

Here, in the embodiment of the present invention the dummy scan lines DS[1a], DS[1b] are configured as two dummy scan lines, i.e., a pair of dummy scan lines, as shown. However, the present invention is not thereby limited.

The data driver 20 receives the data driving control signal (DCS) and the digital data from the timing controller 50, and the data driver 20 receiving the digital data and the data driving control signal (DCS) generates gray scale voltages (or gray levels or gray scale signals) corresponding to the digital data, and supplies the generated gray scale voltages to the corresponding pixels that are turned on by the scan signals.

However, when generating gray scale voltages, one embodiment of the present invention uses parasitic capacitance components existing in at least two data lines of a plurality of data lines provided on a panel of a display device and also capacitance components existing in pixels and dummy pixels connected to the respective data lines as a sampling capacitor and a holding capacitor, thereby generating the desired gray scale voltages through the charge sharing between the data lines.

That is, when generating certain or predetermined gray scale voltages through charge sharing between first data lines and second data lines adjacent to the respective first data lines and transmitting the gray scale voltages to the corresponding pixels connected to the first data lines, one embodiment of the present invention executes the charge sharing by using the parasitic capacitance components existing in the first data lines and the capacitance components existing in the corresponding pixels connected to the first data lines, and the parasitic capacitance components existing in the second data lines and the capacitance components existing in the dummy pixels connected to the second data lines, respectively, as the holding capacitor and the sampling capacitor.

As such, one embodiment of the present invention as described above properly (or correctly) executes the charge sharing by connecting the dummy pixels with the second data lines to block or prevent the input of the gray scale voltages distorted due to the capacitance components existing in the corresponding pixels connected to the first data lines.

Here, the connections of the corresponding pixels and the dummy pixels with the data lines are made when the scan signals are applied through the scan lines connected to the corresponding pixels and when the dummy signals are applied through the dummy scan lines connected to the dummy pixels.

In the case of the embodiment as shown in FIG. 3, the scan lines S[j] connected to the respective pixels include two S[ja], S[jb] for every row line, and a line time that the scan signals are applied to the scan lines becomes a half of an existing (or conventional) line time.

That is, in the embodiment described above, the sum of the first data line time that the scan signal is applied to the first scan line S[ja] and the second data line time that scan signals is applied to the second scan line S[jb] becomes the existing line time.

However, the above only describes the case of FIG. 3, that is, only the case of generating the gray scale voltages corresponding to one data line by using the two neighboring data lines, and the present invention is not thereby limited. For example, one embodiment of the present invention uses the sum values of the respective parasitic capacitance components existing in two or more data lines, that is, k ($k \geqq 2$) data lines, as the sampling capacitor and/or the holding capacitor, and the line time that the scan signal is applied to the scan line is reduced to 1/k of the existing line time and k number of scan lines S[n] should be connected to each pixel on the flat panel display device.

Figure 4:
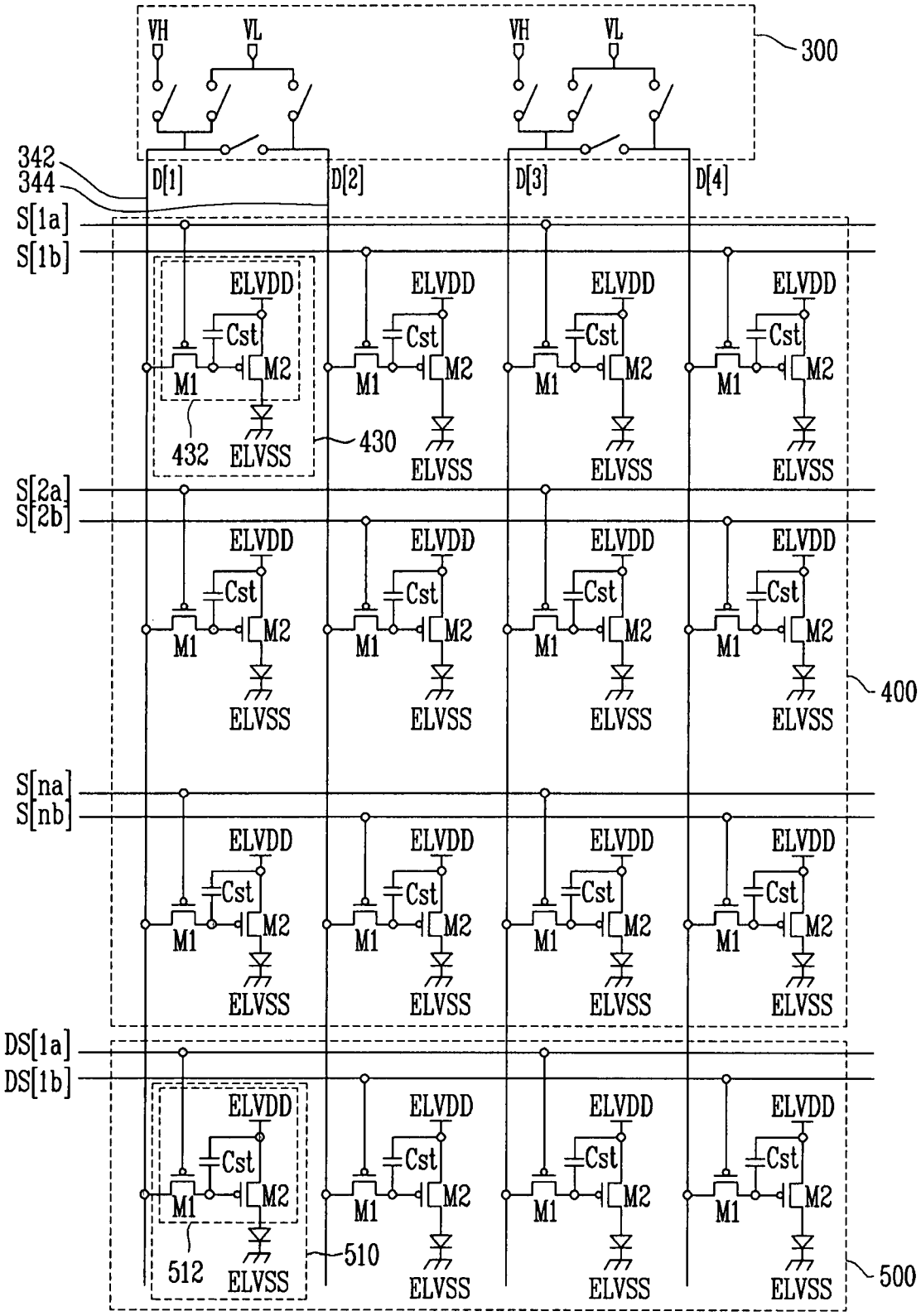
FIG. 4 is a block diagram showing a display region and a dummy display region of a flat panel display device according to an embodiment of the present invention and a partial constitution of a data driver according to the embodiment of the present invention.

FIG. 4 is a block diagram showing a display region 400 and a dummy display region 500 of a flat panel display device according to an embodiment of the present invention and a partial constitution of a data driver according to the embodiment of the present invention.

However, although the flat panel display device as shown in FIG. 4 describes, by way of an example, an organic light-emitting display device, it is only one example of the flat display device according to the present invention, and the present invention is not thereby limited. Also, the constitutions of pixels 430 and dummy pixels 510 as shown in FIG. 4 are only one embodiment of the present invention, and the present invention is not thereby limited.

As shown in FIG. 4, each of the pixels 430 and the dummy pixels 510 provided on the flat panel display device according to the embodiment of the present embodiment includes an organic light-emitting diode OLED and a pixel circuit 432, 512 adapted to control whether the organic light-emitting diode OLED is light-emitted by connecting the data lines with the scan lines or the data lines with the dummy scan lines.

The pixels 430 constitute the display region 400 of the display device and display certain or predetermined colors by the input gray scale voltages, and the dummy pixels 510 constitute the dummy display region 500 provided in a non-display region of the display device.

Here, when the gray scale voltages generated by charge sharing between the first and second data lines 342,344 adjacent to each other are applied to the corresponding pixels 430, the dummy pixels 510 correctly execute the charge sharing by connecting with the second data line D[2] 342 to thus block or prevent the input of the gray scale voltages distorted due to the capacitance components existing in the corresponding pixels 430 connected to the first data line D[1] 342.

That is, the present invention uses the parasitic capacitance components existing in the data lines, for example, the first data lines 342 and the second data lines 344 adjacently arranged to the respective first data lines, and the capacitance components in the pixels 430 and the dummy pixels 510 connected to the first data lines 342 and the second data lines 344, respectively, as the sampling capacitor and the holding capacitor, thereby forming the desired gray scale voltages through the charge sharing between the data lines.

In other words, when generating gray scale voltages (or predetermined gray scale voltages) through charge sharing between the first data lines 342 and the second data lines 344 adjacent thereto and transmitting the gray scale voltages to the corresponding pixels connected to the first data lines 342, the parasitic capacitance components existing in the first data lines 342 and the capacitance components existing in the corresponding pixels 430 connected to the first data lines 342, and the parasitic capacitance components existing in the second data lines 344 and the capacitance components existing in the corresponding dummy pixels 510 connected to the second data lines 344, respectively, are used as the holding capacitor and the sampling capacitor, thereby executing charge sharing.

Here, the connections of the pixels 430 and the dummy pixels 510 corresponding to the respective first and second data lines 342,344 are made when the scan signals are applied through scan line S[a1] connected to the corresponding pixels 430 and when the dummy signals are applied through dummy scan line DS[1b] connected to the dummy pixels 510.

As shown in FIG. 4, an anode electrode of the organic light-emitting diode OLED provided in the pixels 430 and the dummy pixels 510 is connected to the pixel circuits 432,512, and a cathode electrode thereof is connected to a second power source ELVSS. Such an organic light-emitting diode OLED is light-emitted depending on the current supplied from the pixel circuits 432, 512.

The pixel circuits 432, 512 are turned on when the scan signals are supplied through the scan lines or the dummy scan lines, and in particular, in the case of the pixels 430 provided in the display region 400, the pixel circuits 432, 512 control whether the organic light-emitting diode is light-emitted depending on the gray scale voltages (or the predetermined gray scale voltages) generated and provided by the charge sharing between the first and second data lines 342, 344 adjacent to each other.

To provide the above, each of the pixel circuits 432, 512 includes: a second transistor M2 connected between a first power source ELVDD and the organic light-emitting diode OLED; a first transistor M1 connected between the second transistor M2 and the data lines and the scan lines or between the second transistor M2 and the data lines and the dummy scan lines; and a storage capacitor Cst connected between a gate electrode of the second transistor M2 and a first electrode of the second transistor M2.

A gate electrode of the first transistor M1 is connected to the scan lines or the dummy scan lines, and a first electrode thereof is connected to the data lines. Also, a second electrode of the first transistor M1 is connected to a first terminal of the storage capacitor Cst. The first transistor M1 is turned on when the scan signals are supplied to the scan lines or the dummy scan lines. Accordingly, in the case of the pixels provided in the display region 400, the first transistor M1 supplies the gray scale voltages supplied through the first data lines connected thereto to the storage capacitor Cst. In addition, the first electrode is any one of a source electrode or a drain electrode, and the second electrode is an electrode other than the first electrode. For example, if the first electrode is a source electrode, the second electrode is a drain electrode.

Also, the gate electrode of the second transistor M2 is connected to the first terminal of the storage capacitor Cst, and the first electrode of the second transistor M2 is connected to a second terminal of the storage capacitor Cst and the first power source ELVDD. In addition, the second electrode of the second transistor M2 is connected to the organic light-emitting diode OLED. The second transistor M2 controls whether the organic light-emitting diode is light-emitted depending on the current stored in the storage capacitor Cst. That is, when a gray scale voltage is charged in the storage capacitor Cst, the second transistor M2 allows the corresponding current to flow into the organic light-emitting diode, to light-emit it.

Also, the data lines are connected to a data driver, and the data driver is for receiving digital data, for generating gray scale voltages depending on input digital data through charge sharing between the neighboring data lines, and for providing the gray scale voltages to the corresponding pixels.

Referring to FIG. 4, the data driver includes a digital-analog converter (DAC) 300 having a plurality of switches connected to the neighboring data lines. That is, only the digital-analog converter 300 in the data driver is shown in FIG. 4.

Here, the digital-analog converter 300 is adapted to execute charge sharing between the neighboring data lines, thereby finally generating analog gray scale voltages corresponding to the digital data input to the data driver. The structures and the operations thereof will be described in more detail below with reference to FIG. 5 to FIG. 7.

Figure 5:
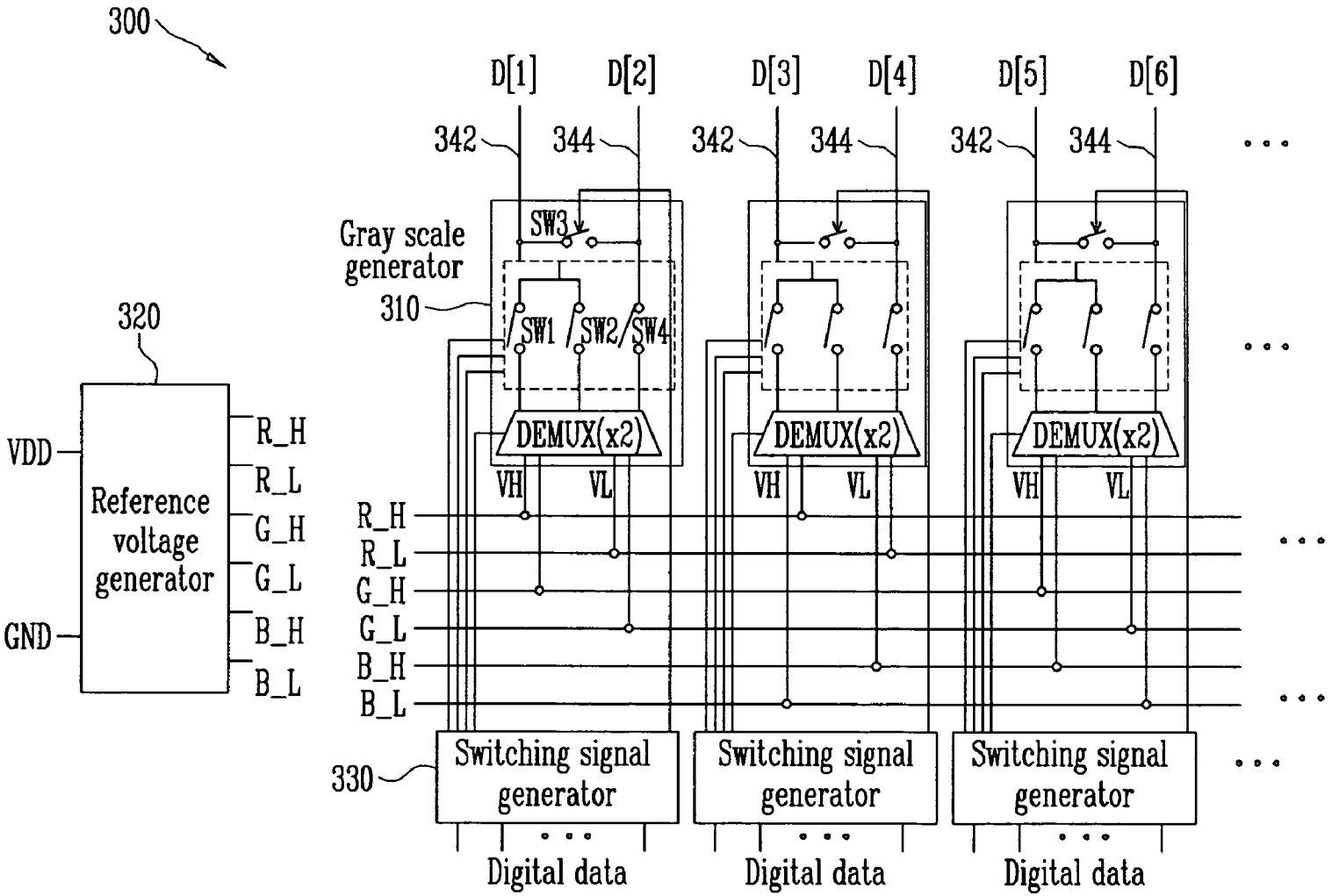
FIG. 5 is a block diagram showing an digital-analog converter (DAC) according to an embodiment of the present invention.

FIG. 5 is a block diagram showing a digital-analog converter (DAC) according to an embodiment of the present invention.

As briefly described in FIG. 4, the DAC 300 uses the parasitic capacitance components existing in the at least two data lines of the plurality of data lines provided on the panel of the display device and the capacitance components in pixels and dummy pixels connected to the respective data lines, respectively, as a sampling capacitor and a holding capacitor, thereby generating analog gray scale voltages corresponding to the digital data input to the data driver through the charge sharing between the data lines and providing the gray scale voltages to the corresponding pixels.

The embodiment as shown in FIG. 5 describes by way of an example, the charge sharing for the two neighboring data lines, that is, the case to execute the charge sharing by using the parasitic capacitance components existing in the first data lines and the capacitance components in the corresponding pixels connected to the first data lines, and the parasitic capacitance components existing in the second data lines formed adjacent to the first data line and the capacitance components in the dummy pixels connected to the second data lines, respectively, as the holding capacitor and the sampling capacitor.

However, it is only one embodiment and the present invention, and the present invention is not thereby limited.

That is, for example, one embodiment of the present invention uses the sum values of the respective parasitic capacitance components existing in two or more data lines, that is, k ($k \geqq 2$) data lines, as the sampling capacitor and/or the holding capacitor. In another embodiment, it is also possible to use the respective parasitic components existing in the at least two data lines receiving the same color of data, not the two neighboring data lines, as the sampling capacitor and/or the holding capacitor.

Referring to FIG. 5, the DAC 300 according to an embodiment of the present invention includes: a gray scale generator 310 for executing charge sharing (or sharing of charges) between first data lines 342 and second data lines 344, respectively, a switching signal generator 330 for providing operation control signals for a plurality of switches provided in the gray scale generator 310; and a reference voltage generator 320 for generating reference voltages and providing them to the gray scale generator 310.

The first and second data lines 342, 344, are applied with certain or predetermined gray scale voltages, provide the gray scale voltages to corresponding or predetermined pixels connected to the data lines, and use parasitic capacitance components in the data lines themselves.

In general, the data lines 342, 344 can be modeled in the form of a plurality of resistors and capacitors that are connected, and therefore the capacitance values of the entire data lines can also be modeled or standardized with certain or predetermined values depending on the panel size, etc.

Therefore, the embodiment of the present invention uses the respective parasitic capacitance components existing in the two neighboring data lines 342, 344 as the sampling capacitor and the holding capacitor.

However, according to the embodiment of the present invention, other than the parasitic components existing in the data lines, the sampling and holding capacitors further include the capacitance components in the pixels 430 in FIG. 4 and the dummy pixels 510 in FIG. 4 connected to the respective data lines.

That is, when generating the gray scale voltages through charge sharing between the first data lines 342 and the second data lines 344 adjacent thereto and transmitting the gray scale voltages to the corresponding pixels 430 connected to the first data lines 342, the parasitic capacitance components existing in the first data lines 342 and the capacitance components in the corresponding pixels 430 connected to the first data lines 342, and the parasitic capacitance components existing in the second data lines 344 and the capacitance components in the dummy pixels 510 connected to the second data lines 344, respectively, are used as the holding capacitor and the sampling capacitor, thereby executing the charge sharing of the embodiment of the present invention.

The charge sharing is properly (or correctly) executed by connecting the dummy pixels 510 with the second data lines 344 to block or prevent the input of the gray scale voltages distorted due to the capacitance components existing in the corresponding pixels 430 connected to the first data lines 342.

Here, the connections of the corresponding pixels 430 and the dummy pixels 510 with the data lines 342, 344 are made when the scan signals are applied through the scan lines connected to the corresponding pixels 430 and when the dummy signals are applied through the dummy scan lines connected to the dummy pixels 510.

According to the embodiment of the present invention the scan signals and the dummy scan signals applied to the corresponding pixels 430 and the dummy pixels 510 are equally (or identically) applied to the corresponding pixels 430 and the dummy pixels, and are thus turned on at the same time (or substantially the same time).

However, the present invention is not thereby limited. For example, one embodiment of the present invention uses the sum values of the respective parasitic capacitance components existing in two or more data lines, that is, k (k≧2) data lines, as the sampling capacitor and/or the holding capacitor. In another embodiment, it is also possible to use the respective parasitic components existing in the at least two data lines receiving the same color of data, not the two neighboring data lines, as the sampling capacitor and/or the holding capacitor.

However, in the case of the embodiment shown in FIG. 5, since the parasitic capacitance components existing in the two neighboring data lines, that is, in the data lines receiving different colors are used, the gray scale generator 310 is provided with a demultiplexer 316 to differentiate reference voltages for every data line. This is because the two neighboring data lines may receive the data corresponding to different colors; and the reference voltages may be different every red, green, and blue (R, G, B) color.

Therefore, in this case, when using the respective parasitic capacitance components existing in the at least two data lines receiving the same color as the sampling capacitor and/or the holding capacitor, the gray scale generator 310 does not need to include the demultiplexer 316.

Figure 6:
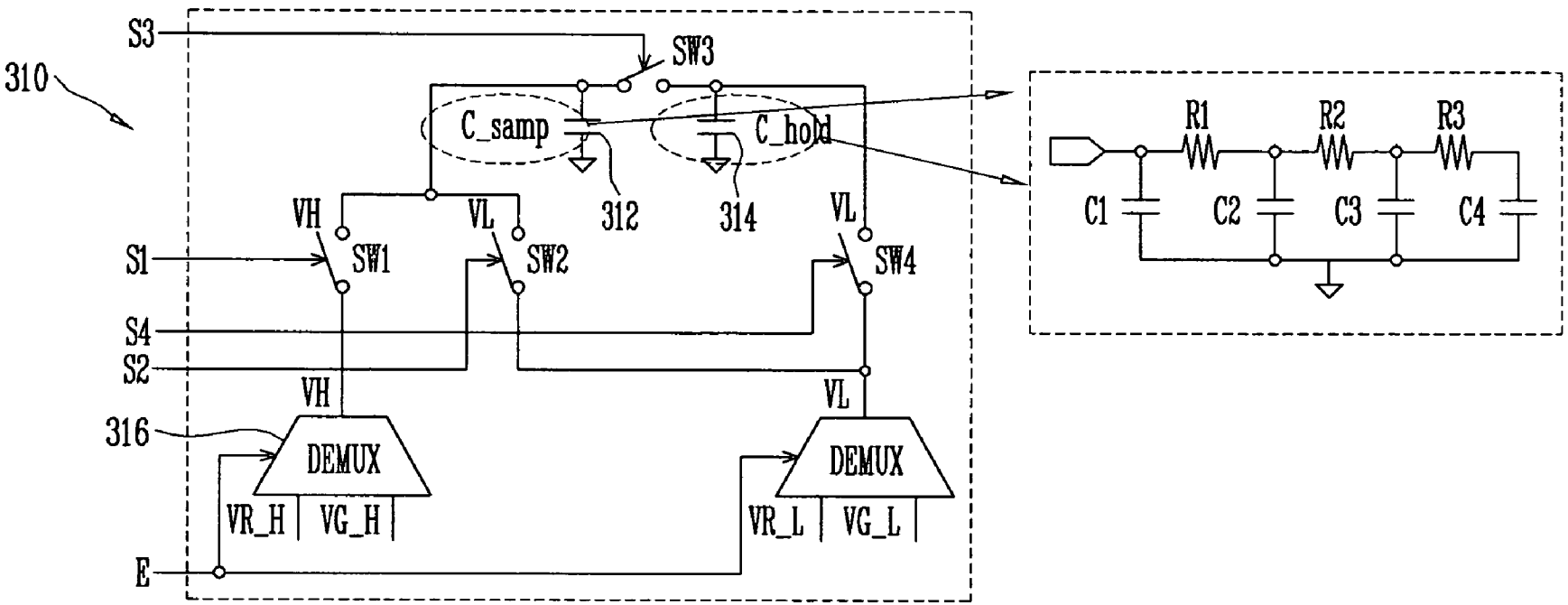
FIG. 6 is a block diagram showing a gray scale generator of the DAC of FIG. 5.
Figure 7:
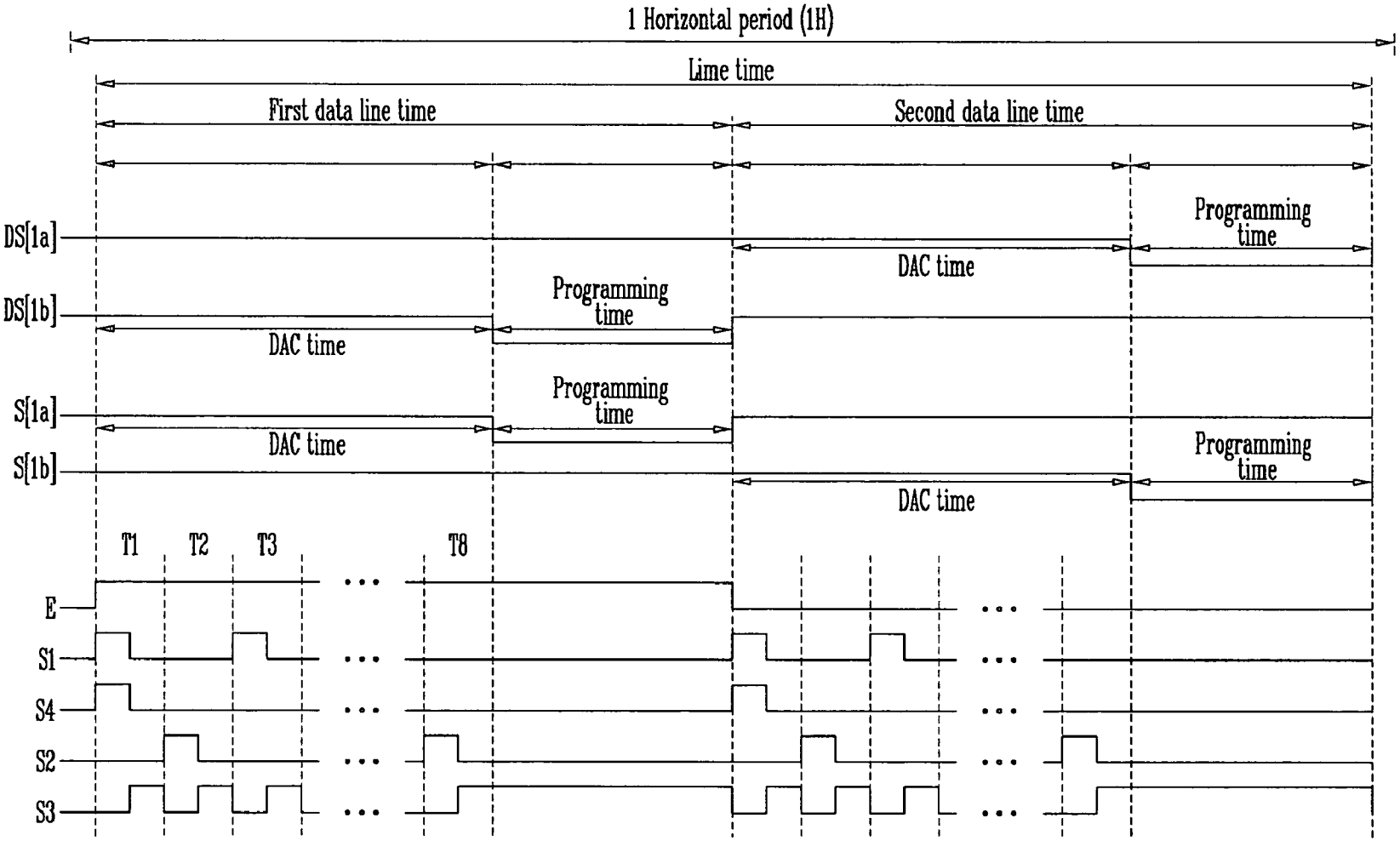
FIG. 7 is a signal waveform diagram showing an example of digital data input to the gray scale generator shown in FIG. 6.

FIG. 6 is a block diagram showing the gray scale generator 310 in more detail, and FIG. 7 is a signal waveform diagram showing one example of digital data input to the gray scale generator 310.

Figure 8:
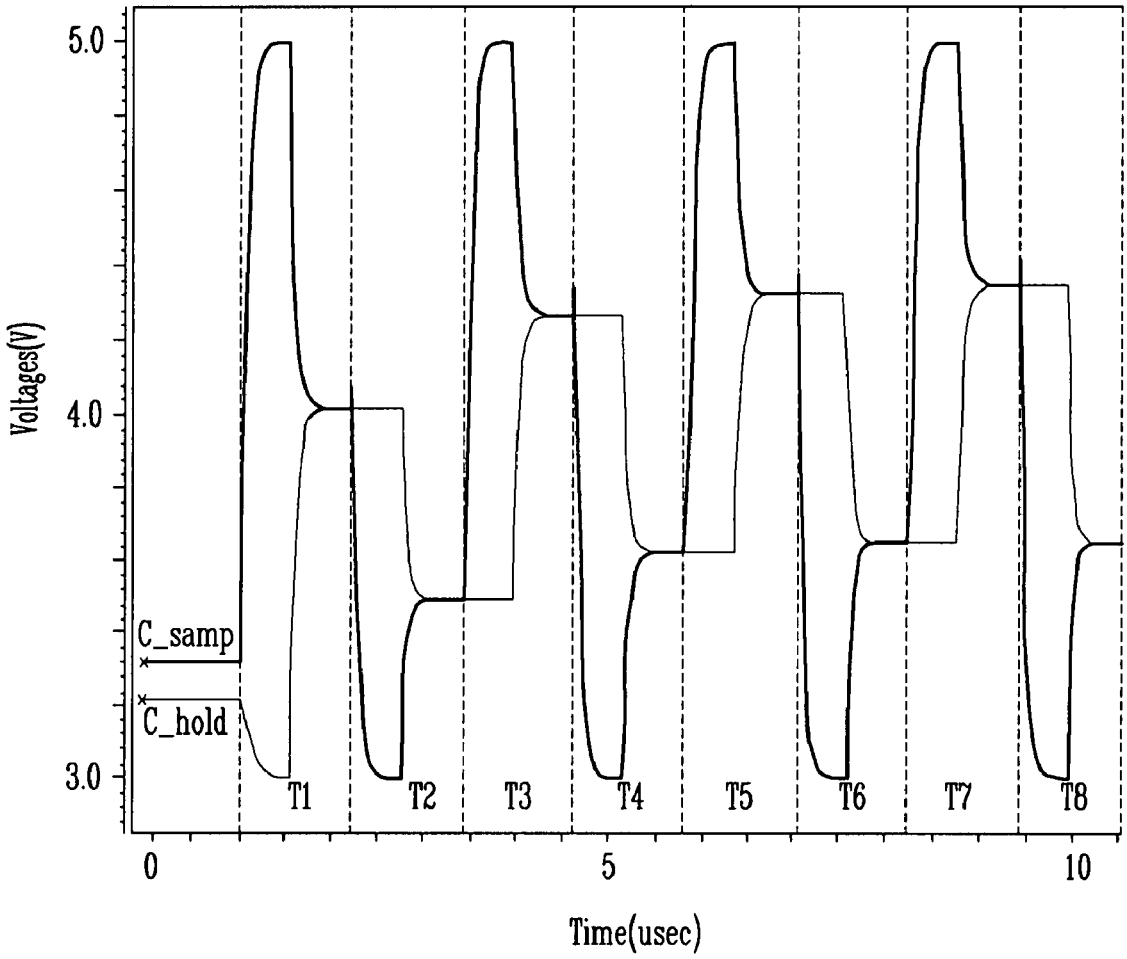
FIG. 8 is a simulation waveform diagram showing outputs of the gray scale generator for the inputs shown in FIG. 7.

Also, FIG. 8 is a simulation waveform diagram showing outputs of the gray scale generator for the inputs shown in FIG. 6.

However, in the case of one of the above described embodiments of the present invention, since the gray scale voltages corresponding to one data line are generated by using the two neighboring data lines, the panel is driven as a 1:2 demuxing method, and thus the time that the respective data lines are driven can be reduced to a half of the existing (or conventional) time.

Therefore, as shown in FIG. 3 and FIG. 4, the scan lines S[n] connected to the respective pixels of the flat panel display device according to the embodiment of the present invention include two S[na], S[nb] for every row line, and the line time corresponding to the respective scan lines becomes a half of the existing time.

That is, referring to FIG. 7, in the case of one of the above described embodiments according to the present invention, the gray scale voltages corresponding to the pixels connected to the first scan line S[1a] are generated, the gray scale voltages corresponding to the pixels connected to the second scan line S[1b] are generated, and the sum of the applied first data line time and the applied second data line time becomes the existing lime time. Here, the line time generally corresponds to the period within one horizontal period 1H.

Also, the time that the gray scale voltages corresponding to the input digital data for each data line time are generated becomes a DAC time, and the time that the generated gray scale voltages are applied to the corresponding pixels becomes a programming time.

Accordingly, as shown in FIG. 7, the scan signals provided to the respective scan lines are provided at a low level (or a low voltage level) only during the programming time.

Also, as shown in FIG. 7, during the programming time, the level of the scan signals provided to the dummy scan lines are opposite to that of the scan signals provided to the scan lines, that is, when the scan signals are provided at a low level through a first scan line S[1a], the scan signals are provided at a high level to a first dummy scan line DS[1a], and when the scan signals are provided at a high level through a second scan line S[1b], the scan signals are provided at a low level to a second dummy scan line DS[1b].

As a result, if the corresponding pixels connected to the first data lines are turned on by the corresponding scan lines, the dummy pixels connected to the second data lines are turned on by the corresponding dummy scan lines at the same time.

However, this describes the case of the embodiment of FIG. 4, that is, the case of generating the gray scale voltage corresponding to one data line by using the two neighboring data lines. In the case of using the sum values of the respective parasitic capacitance components existing in the at least two data lines, that is, k (k≧2) data lines as the sampling capacitor or the holding capacitor, the line time that the scan signals are applied to the scan line is reduced to 1/k of the existing line time and k number of scan lines should be connected to each pixel in the flat panel display device.

Referring to FIG. 6, the gray scale generator 310 includes: a sampling capacitor C_samp 312 formed by the parasitic capacitance components in the first data lines 342 in FIG. 5 and the capacitance components in the corresponding pixels connected to the first data lines; a holding capacitor C_hold 314 formed by the parasitic capacitance components in a second data lines 344 in FIG. 5 and the capacitance components in the dummy pixels 510 in FIG. 4 connected to the second data lines; a first switch SW1 for controlling reference voltage(s) at high level(s) VH to be supplied to the sampling capacitor 312 depending on the respective bit values of the input digital data; a second switch SW2 for controlling reference voltage(s) at low level(s) VL to be supplied to the sampling capacitor 312 depending on the respective bit values of the input digital data; and a third switch SW3 provided for charge sharing between the sampling capacitor and the holding capacitor.

That is, the first and the second data lines, and the respective pixels and dummy pixels connected thereto can be modeled in the form such that a plurality of resistors R1, R2, R3 and capacitors C1, C2, C3 that are connected, and therefore the capacitance components in the entire data lines can also be modeled or standardized with certain or predetermined values depending on to panel size, etc. In one embodiment of the present invention, the first and the second data lines are used as the sampling capacitor C_samp 312 and holding capacitor C_hold 314.

In the embodiment of the present invention, although the capacitance components in the first data lines are used as the sampling capacitor C_samp, and the capacitance components in the second data lines are used as the holding capacitor C_hold, it is only one embodiment of the present invention, and the present invention is not thereby limited. That is, it is also possible to use the capacitance components in the first data line as the holding capacitor C_hold, and to use the capacitance components in the second data line as the sampling capacitor C_samp.

Also, the gray scale generator 310 is further provided with a fourth switch SW4 connected to the holding capacitor C_hold for initializing the holding capacitor C_hold.

Also, the embodiment of the present invention that generates the gray scale voltages corresponding to one data line uses the two neighboring data lines and drives the panel using the 1:2 demuxing method. Therefore, each data line transfers image signals corresponding to different colors of R, G, B and since the reference voltages corresponding to each color are different, the reference voltages must be differentiated for every data line.

Therefore, as shown, the gray scale generator 310 according to the embodiment of the present invention further includes a demultiplexer 316 for distinguishing and supplying reference voltage every data line.

That is, the demultiplexer 316 does not supply the reference voltages corresponding to the second data lines when the certain or predetermined gray scale voltages are supplied to the first data lines, and does not supply the reference voltages corresponding to the first data lines when the certain or predetermined gray scale voltages are supplied to the second data lines. Here, two demultiplexers may be provided to supply the reference voltages every level.

In one embodiment, when using the parasitic capacitance components existing in two or more data lines receiving only the data of the same color as a sampling capacitor and/or the holding capacitor, the demultiplexer 316 is not needed in the gray scale generator 310.

In the embodiment of FIG. 6, the signals S1, S2, S3, S4, and a signal E are provided from the switching signal generator 330 shown in FIG. 5, and the high level and the low level of reference voltages are provided from the reference voltage generator 320. Here, the signal E is for controlling the operations of the first, second, third, and fourth switches SW1, SW2, SW3, SW4 and the demultiplexer 316.

An operation of the gray scale generator 310 will be described with reference to FIG. 6 to FIG. 8.

First, the sampling capacitor C_samp is set to a high level VH or a low level VL of the reference voltages depending on the least significant bit LSB of the input digital data.

That is, when the least significant bit LSB of the input digital data is 1 (LSB=1), the first switch SW1 is turned on to provide the reference voltage at the high level VH to the sampling capacitor C_samp 312, resulting in the sampling capacitor C_samp 312 being set to the reference voltage at the high level VH. In addition, when the least significant bit LSB of the digital data is 0 (LSB=0), the second switch SW2 is turned on to provide the reference voltage at the low level VL to the sampling capacitor C_samp 312, resulting in the sampling capacitor C_samp 312 being set to the reference voltage at the low level VL. After this, the charge sharing between the sampling capacitor C_samp 312 and the holding capacitor C_hold 314 is made.

According to the embodiments shown in FIG. 7 and FIG. 8, there is described below as an example that the input digital data [d7d6d5d4d3d2d1d0] are [01010101]. Therefore, the LSB of the digital data is 1, resulting in the sampling capacitor C_samp 312 being set to the reference voltage at the high level VH. This is as shown in a simulation graph of FIG. 8.

Also, the holding capacitor C_hold 314 is initialized simultaneously with inputting of the LSB of the sampling capacitor C_samp 312. This is made by turning on the fourth switch SW4.

As shown in FIG. 6, the holding capacitor C_hold 314 is initialized with the reference voltage at the high level VL. That is, by turning on the fourth switch SW4, the reference voltage at the low level VL is provided to the holding capacitor C_hold 314 so that the holding capacitor C_hold 314 is initialized with the reference voltage of the low level VL. This is as shown in the simulation graph of FIG. 8.

However, the present invention is not thereby limited and the holding capacitor C_hold 314 can be initialized with the reference voltage at the high level VH or the reference voltage at the low level VL.

When assuming that the input digital data are 8 bits as shown in FIG. 7 and FIG. 8, the gray scale generator 310 executes the charge sharing between the sampling capacitor C_samp 312 and the holding capacitor C_hold 314 during the 8 periods where the respective bits are input, and the result is that the $8^{th}$ charge sharing that is finally executed becomes the final gray scale voltages that are applied to the corresponding or predetermined pixels through the data lines.

That is, for the input digital data, in the period T1 for receiving the first LSB and the respective periods T2, T3, T4, T5, T6, T7, and T8 for respectively receiving the next bits, from the second lower bit to the most significant bit MSB so that the first switch (when the bit value is 1) or the second switch (when the bit value is 0) is turned on depending on the respective bits to store the certain or predetermined reference voltages in the sampling capacitor C_samp 312, the third switch SW3 is turned on for a certain or predetermined period of the respective periods to apply the charge sharing between the reference voltages stored in the sampling capacitor C_samp 312 and the voltages stored in the holding capacitor C_hold 314.

As a result, the certain or predetermined gray scale voltages corresponding to the digital data input through the charge sharing in the last $8^{th}$ period T8 are generated and provided to the corresponding pixels.

Under the assumption that the 8 bits digital data with [01010101] is provided during the first data line time, that is, during the period corresponding to a half of the existing line time, an operation of the embodiment shown in FIG. 7 and FIG. 8 will be described in more detail below.

First, in the first period T1, the LSB of the input digital data [01010101] is 1 and the first switch SW1 is thus turned on so that the reference voltage at the high level VH is stored in the sampling capacitor C_samp 312 to set the sampling capacitor C_samp 312 to the reference voltage at the high level VH.

Also, the holding capacitor C_hold 314 is provided with the reference voltage at the low level VL by turning on the fourth switch SW4 so that it is initialized with the reference voltage at the low level VL.

Therefore, in the certain or predetermined period of the first period, that is, the period of the remaining first period after the first switch SW1 is turned on, the third switch SW3 is turned on so that the voltages stored in the sampling capacitor C_samp 312 and the charges stored in the holding capacitor C_hold 314 are distributed, thereby being converted and stored into the voltages corresponding to a middle level of voltage stored in the respective sampling and holding capacitors 312 and 314.

Next, in the second period T2, since the second lower bit is 0, the second switch SW2 is turned on so that the reference voltage at the low level VL is stored in the sampling capacitor C_samp 312 and in the certain or predetermined period of the second period, that is, in the remaining second period after the second switch SW2 is turned on, the third switch SW3 is turned on so that the voltages stored in the sampling capacitor C_samp 312 and the charges stored in the holding capacitor C_hold 314 are distributed, thereby being converted and stored into the voltages corresponding to a middle level of voltage stored in the respective sampling and holding capacitors.

Next, from the third period to the eighth period T3 to T8, depending on the bits input as in the second period, the first switch SW1 is turned on (when the bit is 1) or the second switch SW2 is turned on (when the bit is 0), resulting in the reference voltage at the high level VH or the reference voltage at the low level VL being stored in the sampling capacitor, respectively. Among the respective periods in the period after the first switch SW1 or the second switch SW2 is turned on, the third switch SW3 is turned on so that the reference voltages stored in the sampling capacitor C_samp 312 and the charges stored in the holding capacitor C_hold 314 are distributed, resulting in the voltages of a middle level being stored in the sampling and the holding capacitors.

As a result, in the last eighth period T8, the voltages distributed in the sampling and holding capacitors finally become the gray scale voltages corresponding to the input digital data, and such gray scale voltages are provided to the corresponding or predetermined pixels connected to the first data lines.

That is, when generating the gray scale voltages through charge sharing between the first data lines and the second data lines and then transmitting the gray scale voltages to the corresponding pixels connected to the first data lines, the embodiment of the present invention executes the charge sharing by using the parasitic capacitance components existing in the first data lines and the capacitance components in the corresponding pixels connected to the first data lines, and the parasitic capacitance components existing in the second data lines and the capacitance components in the dummy pixels connected to the second data lines, respectively, as the sampling capacitor and the holding capacitance. By connecting the dummy pixels with the second data lines and using them as the holding capacitor as described above, the embodiment of the present invention blocks or prevents the input of the gray scale voltages distorted due to the capacitance components existing in the corresponding pixels connected to the first data lines.

Here, the connections of the respective corresponding pixels and dummy pixels with the first and the second data lines are made when the scan signals are applied through the scan lines connected to the corresponding pixels and when the dummy scan signals are applied through the dummy scan lines connected to the dummy pixels.

That is, if the corresponding pixels connected to the first data lines are turned on by the predetermined data lines, the dummy pixels connected to the second data lines are turned on by the predetermined dummy scan lines at the same time.

Also, the respective lower ends of the first switch SW1,the second switch SW2, and the fourth switch SW4 are provided with the demultiplexer 316 so that the reference voltages corresponding to the first data lines or the second data lines are divided and provided.

That is, the control signal E of the demultiplexer 316 is provided to the demultiplexer 316 during the first to the eighth periods T1 to T8 where the digital data bits are input in order to provide the gray scale voltage to the first data line.

However, this is limited to the case of using the parasitic capacitance existing in the two neighboring data, and the present invention is not thereby limited. For example, in one embodiment, when using the parasitic capacitance components existing in two or more data lines receiving only the data of the same color as the sampling capacitor and/or the holding capacitor, the demultiplexer 316 is not needed in the gray scale generator 310.

Next, in providing the gray scale voltage to the second data line, the 8 bits of the digital data are provided during the second line time corresponding to the remaining half of the existing line time so that the first to the fourth switches SW1 to SW4 are operated in the period where the each digital data bit is inputted, thereby generating the certain or predetermined gray scale voltages and providing them to the second data lines by the demultiplexer 316.

Here, when the demultiplexer 316 provides the certain or predetermined gray scale voltages to the first data lines, the reference voltages corresponding to the second data lines should not be provided, and when it provides the certain or predetermined gray scale voltages to the second data lines, the reference voltages corresponding to the first data lines should not be provided. The operation of the demultiplexer is controlled by the control signal E as shown in FIG. 6 and FIG. 7.

However, the embodiment of FIG. 5 as described is for the case of using the two neighboring data lines to generate the gray scale voltages corresponding to the data lines. In the case of using the sum values of the respective parasitic capacitance components existing in two or more data lines, that is, the k ($k \geqq 2$) data lines as the sampling capacitor and/or the holding capacitor, the line time that the scan signals are applied to the scan line is reduced to 1/k of the existing line time and the scan line S[n] connected to each pixel in the flat panel display device uses k number of scan lines for every pixel.

In the DAC 300 according to an embodiment of the present invention, the DAC 300 uses the capacitance components existing in the at least two data lines as the sampling capacitor and the holding capacitor to generate desired gray scale voltages through the charge sharing between the data lines, thereby greatly reducing power consumption over an existing R-string type of DAC of a related art, and also greatly reducing the DAC area over an existing DAC area of a related art by removing a R-string, a decoder, and a switch array in an existing (or conventional) DAC.

Also, the present invention properly or correctly executes the charge sharing by connecting the dummy pixels with the second data lines to block or prevent the input of the gray scale voltages distorted due to the capacitance components existing in the corresponding pixels connected to the first data lines.

Also, the signal generator 330 shown in FIG. 5 functions to generate and provide signals S1, S2, S3, S4, E for controlling the operations of the plurality of switches provided in the gray scale generator 310, wherein the first and second switches SW1, SW2 are determined to be turned on or off depending on the bit values of the input digital data so that the control signals are generated by the bit values of the digital data output in a serial state through the holding latch unit in the data driver as will be described in more detail with reference to FIG. 8.

That is, when the digital data bit value is 1, the switching signal generator 330 generates the control signal S1 for allowing the first switch SW1 to be turned on and provides the control signal to the gray scale generator 310, and when the digital data bit value is 0, the switching signal generator 330 generates the control signal S2 for allowing the second switch SW2 to be turned on and provides the control signal S2 to the gray scale generator.

Also, the fourth switch SW4 should be turned on when the holding capacitor is initialized, and the third switch SW3 should be turned on for a certain or predetermined period of the respective line times, that is, for every period where the respective digital data bits are input. Therefore, since the control signals S3, S4 of the third and fourth switches SW3, SW4 are signals that are repeated for every respective data line time regardless of the input digital data, they can be separately generated from a timing controller and used. This is equally applied to the control signal E for the demultiplexer 316.

Figure 9:
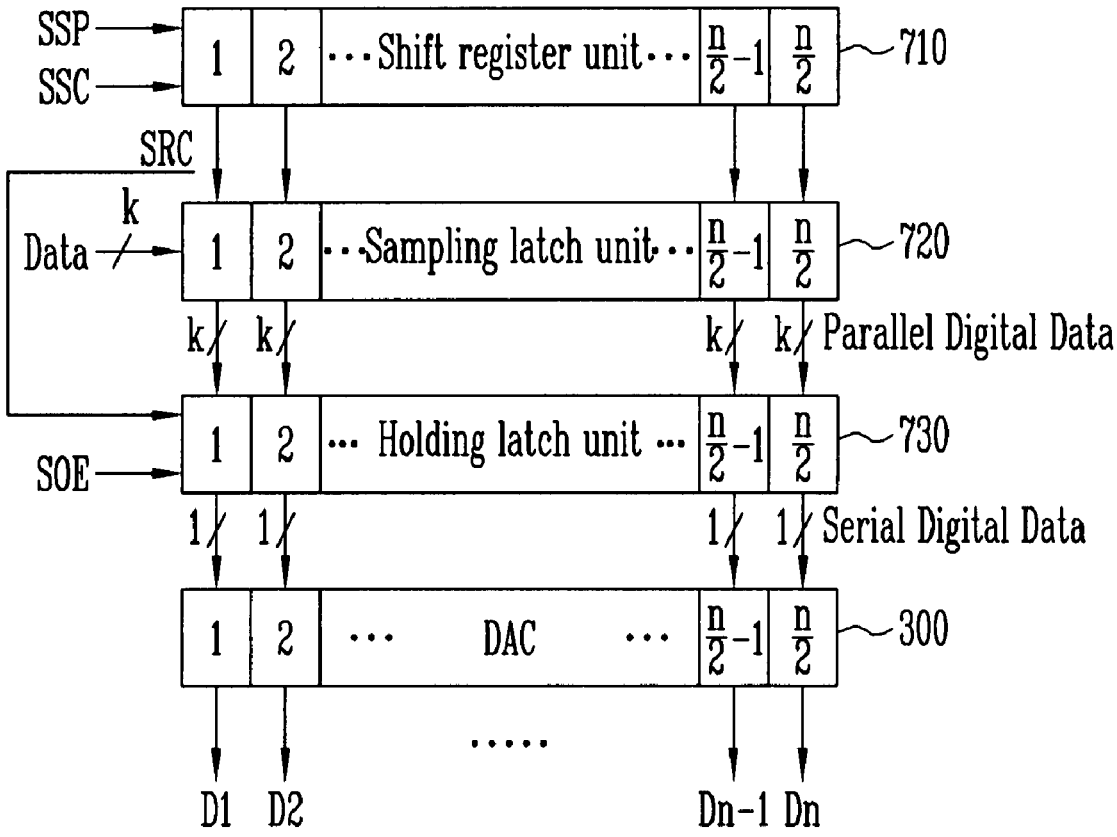
FIG. 9 is a block diagram showing a data driver according to the embodiment of the present invention shown in FIG. 3 and FIG. 4.

FIG. 9 is a block diagram showing a data driver according to an embodiment of the present invention shown in FIG. 3 and FIG. 4.

However, the data driver includes the DAC 300 as described above with reference to FIG. 5 to FIG. 8 and the detailed description of the DAC 300 (including its structures and operations) will not be provided again in more detail.

In the embodiment of the present invention, since the gray scale voltage corresponding to one data line is generated by using the two neighboring data lines, it will be described by way of an example that the panel is driven using a 1:2 demuxing method.

Referring to FIG. 9, the data driver includes a shift register unit 710, a sampling latch unit 720, a holding latch unit 730, and a digital-analog converter (DAC) 300.

Figure 1:
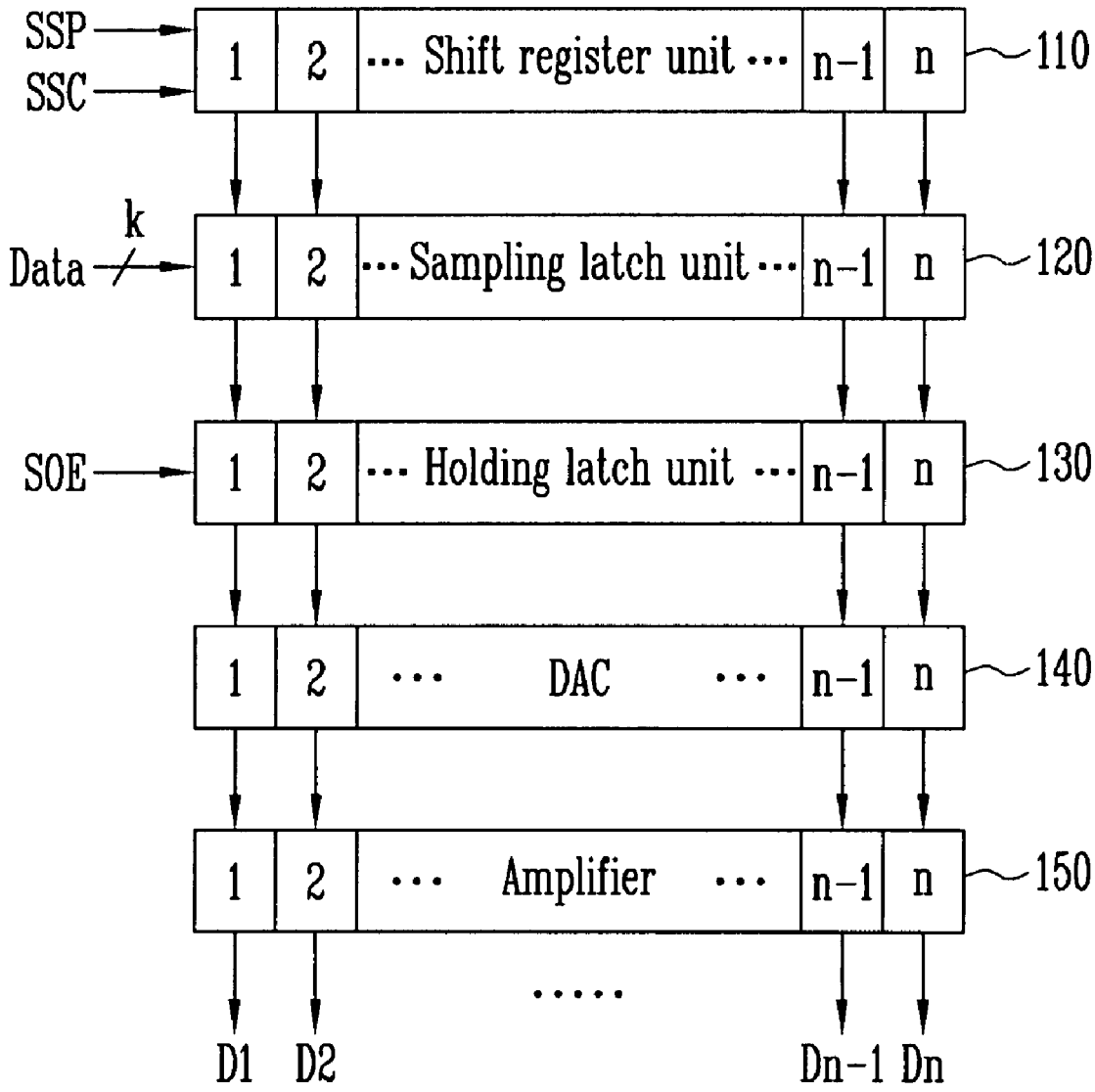
FIG. 1 (RELATED ART)
FIG. 1 is a block diagram showing a conventional data driver.
Figure 2:
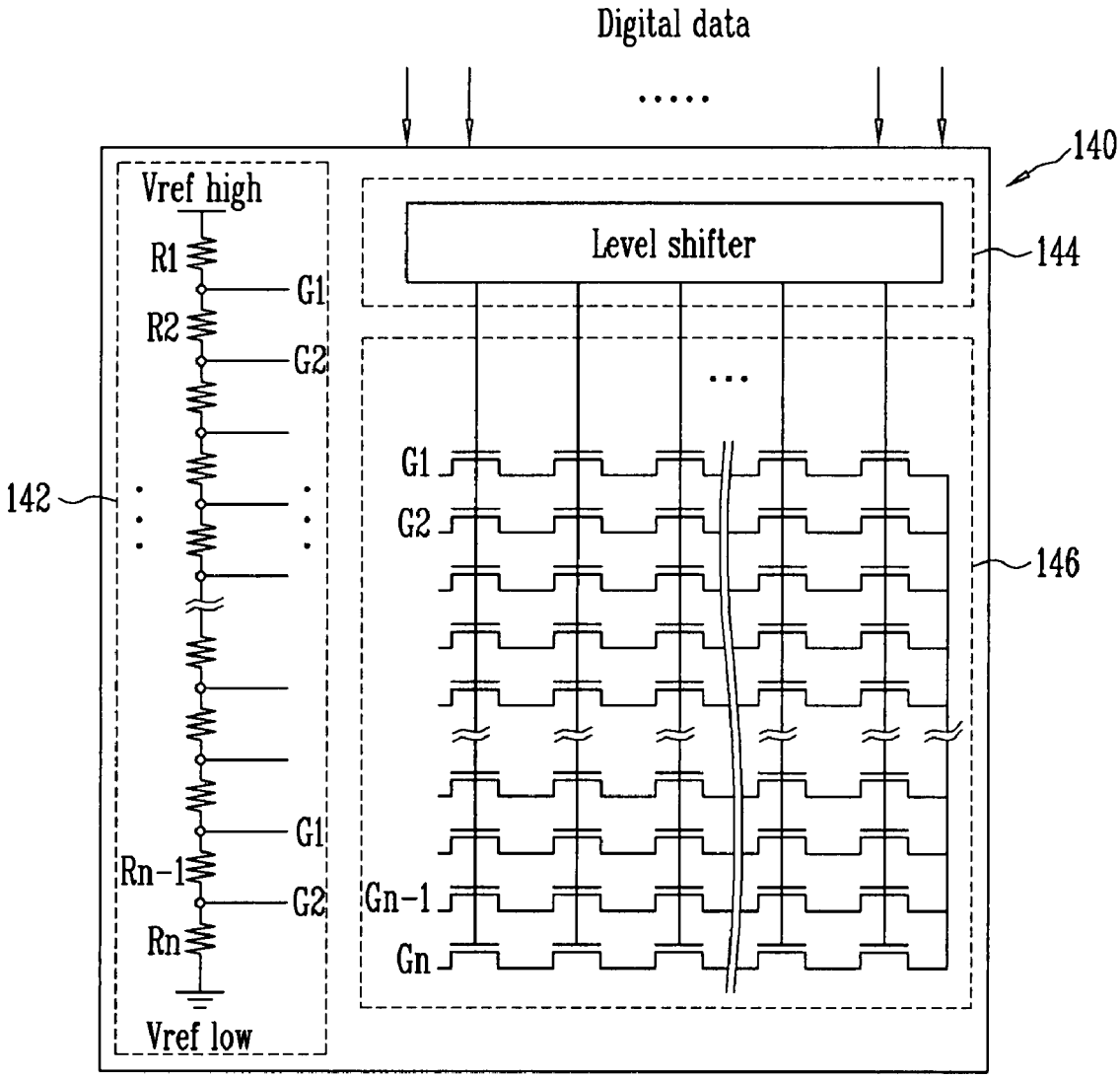
FIG. 2 (RELATED ART)
FIG. 2 is a block diagram showing a digital-analog converter (DAC) of the data driver of FIG. 1.

When the data driver of FIG. 9 is compared with the data driver according to the related art (e.g., shown in FIG. 1), the DAC 300 can be changed such that an analog buffer may not need to be used as an amplifier. As such, the data driver 300 of FIG. 9 has an advantage in that the deterioration of image quality due to the difference of output voltage between channels caused by the analog buffer with non-uniformity (or unevenness) in threshold voltages and mobility can be overcome because the analog buffer does not have to be used as the amplifier.

Also, recently, a flat panel display device using a system on panel (SOP) process that uses polycrystalline silicon TFTs to integrate driver(s), etc., along with a display region on a substrate, has been developed. Therefore, the data driver according to the embodiment of the present invention is capable of overcoming the problems of power consumption and/or area usage, and also overcoming the problem of implementing analog buffer as the amplifier, even when these problems become even more pronounced, when the flat panel display device is implemented using the SOP process.

In FIG. 9, the shift register unit 710 receives a source shift clock (SSC) and a source start pulse (SSP) from a timing controller (not shown), and generates a shift register clock (SRC) as n/2 sampling signals in sequence, while allowing the source start pulse (SSP) to be shifted for every one period of the source shift clock (SSC). Here, the shift register unit 210 includes n/2 shift registers.

The reason why the shift register includes the number corresponding to a half of the number of the channels as described above is that in the embodiment of the present invention, the gray scale voltage corresponding to one data line is generated by using the two neighboring data lines, and the panel is driven using a 1:2 demuxing method.

The sampling latch unit 720 sequentially stores data in response to the sampling signals supplied from the shift register 710 in sequence. Here, the sampling latch unit 720 is provided with n/2 sampling latches for storing n digital data. Also, the respective sampling latches have sizes corresponding to the number of bits of the data. For example, when the data is configured to have 8 bits, the respective sampling latches are set to have the size of 8 bits.

That is, the sampling latch unit 720 sequentially stores the input data and then outputs the 8 bits of the digital data to the holding latch unit 730 in a parallel state.

The holding latch unit 730 receives and stores the data from the sampling latch unit 720 when a source output enable (SOE) signal is input. That is, the holding latch unit inputs and stores the 8 bits of the digital data provided in a parallel state.

Also, the holding latch unit 730 supplies the data stored therein to the DAC 740, when the source output enable (SOE) signal is input. Here, the holding latch unit 730 is provided with n/2 holding latches for storing n data. In addition, the respective holding latches have sizes corresponding to the number of bits of the data. For example, the respective holding latches are set to have the size of 8 bits for storing the 8 bits of the data.

In one embodiment of the present invention, when the 8 bits of the digital data stored in the holding latch unit 730 are output to the DAC 300, they are converted and output in a serial state.

Here, the holding latch unit 730 receives the shift register clock signal (SRC) generated from the shift register and converts the 8 bits of the digital data into a serial state through the clock signal and outputs the serial digital data to the DAC 300, as shown.

The DAC 300 generates analog signals corresponding to the bit values of the input digital data, and the DAC 300 selects any one of a plurality of gray scale voltages (or gray level signals or gray levels) corresponding to the bit values of the data supplied from the holding latch unit 730, thereby generating the analog data signals and outputting them to the respective data lines.

In the present invention, the DAC 300 uses the parasitic capacitance components existing in the at least two data lines of the plurality of data lines provided on the panel and the capacitance components in the pixels and the dummy pixels connected to the respective data lines, respectively, as the sampling capacitor and the holding capacitor, thereby generating the analog gray scale voltages corresponding to the digital data input through the charge sharing between the data lines and providing the gray scale voltages to the corresponding pixels. The constitution and the operation of the DAC 300 have been described above with reference to FIG. 5 to FIG. 8, and the detailed description thereof will thus not be provided again in more detail.

According to the present invention as above, it uses the parasitic capacitance components existing in the at least two data lines and the capacitance components in the pixels and the dummy pixels connected to the respective data lines, respectively, as the holding capacitor and the sampling capacitor to generate the desired gray scale voltages through the charge sharing between the data lines, thereby greatly reducing area and power consumption over the existing R-string type of DAC.

Also, the present invention can remove an R-string, a decoder and a switch array of the existing DAC constitution, thereby greatly reducing the area of DAC over the existing R-string type of DAC.

In addition, when manufacturing the data driver by using a SOP process, an embodiment of the present invention has an advantage in that the deterioration of image quality due to a difference of output voltage between channels due to an analog buffer having variation in threshold voltages and mobility can be overcome because the analog buffer does not have to be used as an amplifier.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A flat panel display device comprising:

a display region including a plurality of pixels connected to a plurality of scan lines and a plurality of data lines;

a dummy display region including a plurality of dummy pixels connected to at least two dummy scan lines and the data lines;

a scan driver for providing scan signals and dummy scan signals to the scan lines and the dummy scan lines;

a data driver for generating gray scale voltages corresponding to input digital data and for providing the gray scale voltages to corresponding ones of the pixels through the data lines; and a timing controller for controlling the scan driver and the data driver, wherein the data driver uses parasitic capacitance components existing in at least two of the data lines and capacitance components in the pixels and the dummy pixels connected to the at least two of the data lines, as a sampling capacitor and a holding capacitor, to generate the gray scale voltages through charge sharing between the at least two of the data lines.

2. The flat panel display device as claimed in claim 1, wherein the scan driver sequentially supplies scan signals to the plurality of scan lines and alternately supplies the scan signals to the at least two dummy scan lines at substantially the same time.

3. The flat panel display device as claimed in claim 1, wherein the sampling capacitor is implemented by the parasitic capacitance components existing in a first one of the data lines and the capacitance component existing in a corresponding one of the pixels connected to the first one of the data lines.

4. The flat panel display device as claimed in claim 3, wherein the holding capacitor is implemented by the parasitic capacitance components existing in a second one of the data lines adjacent to the first one of the data lines and the capacitance component existing in a corresponding one of the dummy pixels connected to the second one of the data lines.

5. The flat panel display device as claimed in claim 4, wherein the corresponding one of the dummy pixels connected to the second one of the data lines is driven along with the corresponding one of the pixels connected to the first one of the data lines.

6. The flat panel display device as claimed in claim 1, wherein the at least two of the data lines are a pair of the data lines adjacent to each other.

7. The flat panel display device as claimed in claim 1, wherein the at least two of the data lines comprises more than two data lines for receiving data of the same color.

8. The flat panel display device as claimed in claim 1, wherein the parasitic capacitance components existing in the at least two of the data lines are sum values of the respective parasitic capacitance components existing in more than two of the data lines.

9. The flat panel display device as claimed in claim 1, wherein the flat panel display device is an organic light-emitting display device.

10. A data driver comprising:

a shift register unit for providing sampling signals by generating at least one shift register clock;

a sampling latch unit for sampling and latching digital data having a plurality of bits by receiving the sampling signals for every column line;

a holding latch unit for simultaneously receiving and latching the digital data latched in the sampling latch unit, and for converting and outputting the digital data in a serial state for each of the bits; and a digital-analog converter for generating gray scale voltages to correspond to bit values of the digital data supplied from the holding latch unit in a serial state and for providing the gray scale voltages to respective data lines, wherein the digital-analog converter uses parasitic capacitance components existing in at least two of the data lines provided on a panel of a display device including the data driver and capacitance components in pixels and dummy pixels connected to the at least two of the data lines, as a sampling capacitor and a holding capacitor to generate the gray scale voltages through charge sharing between the at least two of the data lines.

11. The data driver as claimed in claim 10, wherein the holding latch unit receives a shift register clock signal generated from the shift register, and converts the digital data received in a parallel state into the serial state through the clock signal and outputs the digital data in the serial state to the digital-analog converter.

12. The data driver as claimed in claim 10, wherein the digital-analog converter comprises:

a gray scale generator using the parasitic capacitance components existing in the at least two of the data lines and the capacitance components existing in the pixels and the dummy pixels connected to the at least two of the data lines, as a sampling capacitor and a holding capacitor, to generate desired gray scale voltages through charge sharing between the at least two of the data lines;

a switching signal generator for providing operation control signals for a plurality of switches provided in the gray scale generator; and a reference voltage generator for generating reference voltages and providing the references voltages to the gray scale generator.

13. The data driver as claimed in claim 12, wherein the gray scale generator comprises:

the sampling capacitor formed by the parasitic capacitance components existing in a first one of the data lines and the capacitance components existing in a corresponding one of the pixels connected to the first one of the data lines;

the holding capacitor formed by the parasitic capacitance components existing in a second one of the data lines and the capacitance component existing in a corresponding one of the dummy pixels connected to the second one of the data lines;

a first switch for controlling a reference voltage at a high level to be supplied to the sampling capacitor depending on each bit value of the digital data;

a second switch for controlling a reference voltage at a low level to be supplied to the sampling capacitor depending on each bit value of the digital data;

a third switch provided for applying the charge sharing between the sampling capacitor and the holding capacitor; and a fourth switch connected to the holding capacitor for initializing the holding capacitor.

14. The data driver as claimed in claim 13, wherein the corresponding one of the dummy pixels connected to the second one of the data lines is driven along with the corresponding one of the pixels connected to the first one of the data lines.

15. The data driver as claimed in claim 13, wherein the first switch, the second switch, and the fourth switch are coupled to a demultiplexer so that the reference voltages corresponding to the first data lines or the second data lines are divided and provided.

16. A data driving method of a flat panel display device comprising:

serially inputting respective bits of digital data;

executing charge sharing between data lines by using parasitic capacitance components existing in at least two data lines provided on a panel of the display device and capacitance components in pixels and dummy pixels connected to the at least two data lines, as a sampling capacitor and a holding capacitor, for a plurality of periods during which the respective bits of the digital data are input; and applying a result of the charge sharing executed at a last one of the plurality of periods to corresponding ones of the pixels through the at least two data lines as final gray scale voltages.

17. The data driving method of the flat panel display device as claimed in claim 16, wherein the sampling capacitor is implemented as the parasitic capacitance components existing in a first one of the data lines and the capacitance components existing in a corresponding one of the pixels connected to the first one of the data lines.

18. The data driving method of the flat panel display device as claimed in claim 17, wherein the holding capacitor is implemented as the parasitic capacitance components existing in a second one of the data lines adjacent to the first one of the data lines and the capacitance components existing in a corresponding one of the dummy pixels connected to the second one of the data lines.

19. The data driving method of the flat panel display device as claimed in claim 18, wherein the corresponding one of the dummy pixels connected to the second one of the data lines is driven along with the corresponding one of the pixels connected to the first one of the data lines.

20. The data driving method of the flat panel display device as claimed in claim 16, wherein the charge sharing equally distributes reference voltages stored in the sampling and holding capacitors for a period of the plurality of periods.

* * * * *